US011268537B2

(12) United States Patent
Nanjappa et al.

(10) Patent No.: US 11,268,537 B2
(45) Date of Patent: Mar. 8, 2022

(54) INTERFACE FOR A PLENUM FAN

(71) Applicant: Johnson Controls Technology Company, Auburn Hills, MI (US)

(72) Inventors: Vinay Nanjappa, Bangalore (IN); Vishal S. Jagtap, Thane (IN); Chandra S. Yelamanchili, York, PA (US); Marcel P. Ferrere, Dalmatia, PA (US); Anil V. Bhosale, Varunji (IN); Curtis W. Caskey, Dallastown, PA (US); Nitin C. Dabade, Sangli (IN); Prashanti S. Dhawan, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 168 days.

(21) Appl. No.: 16/114,004

(22) Filed: Aug. 27, 2018

(65) Prior Publication Data

US 2020/0040912 A1 Feb. 6, 2020

Related U.S. Application Data

(60) Provisional application No. 62/715,157, filed on Aug. 6, 2018.

(51) Int. Cl.
*F04D 29/60* (2006.01)
*F24F 11/30* (2018.01)
(Continued)

(52) U.S. Cl.
CPC ..... *F04D 29/601* (2013.01); *F24F 11/30* (2018.01); *F24F 11/74* (2018.01); *F24F 11/88* (2018.01);
(Continued)

(58) Field of Classification Search
CPC ..... F04D 25/12; F04D 29/083; F04D 29/162; F04D 29/281; F04D 29/60; F04D 29/601;
(Continued)

(56) References Cited

U.S. PATENT DOCUMENTS 3,659,879 A * 5/1972 Stalph ..... F16L 51/03 285/114
5,148,647 A * 9/1992 Rutledge ..... E04D 13/0315 52/302.1
(Continued)

FOREIGN PATENT DOCUMENTS

WO 2010124388 A1 11/2010

*Primary Examiner* — Christopher Verdier
*Assistant Examiner* — Elton K Wong
(74) *Attorney, Agent, or Firm* — Fletcher Yoder, P.C.

(57) ABSTRACT

Embodiments of the present disclosure are directed to an interface for a fan that includes a first bracket coupled to the fan, where the fan is configured to direct a flow of air through an opening of a duct, and the opening comprises a central axis extending therethrough, a second bracket coupled to a frame surrounding the opening of the duct, where the first bracket and the second bracket are configured to surround the opening of the duct, the second bracket is configured to support the first bracket, and the second bracket is partially radially within the first bracket relative to the central axis of the opening, and a gasket disposed between the first bracket and the second bracket, where the first bracket, the second bracket, and the gasket are configured to sealingly engage with one another without mechanical securement.

20 Claims, 17 Drawing Sheets

(51) Int. Cl.

| | |
|---|---|
| ***F24F 11/88*** | (2018.01) |
| ***F24F 11/74*** | (2018.01) |
| ***F24F 13/02*** | (2006.01) |
| ***F04D 29/28*** | (2006.01) |
| ***F24F 110/00*** | (2018.01) |

(52) U.S. Cl.
CPC ..... *F24F 13/0236* (2013.01); *F24F 13/0254* (2013.01); *F04D 29/281* (2013.01); *F24F 2110/00* (2018.01); *F24F 2221/16* (2013.01)

(58) Field of Classification Search
CPC .. F04D 29/602; F04D 29/626; F24F 13/0236; F24F 13/2054; F24F 2221/16

See application file for complete search history.

(56) References Cited

U.S. PATENT DOCUMENTS

| | | | | |
|---|---|---|---|---|
| 6,669,552 | B1 * | 12/2003 | Beer | E21F 1/04 454/171 |
| 6,745,589 | B2 | 6/2004 | Katatani et al. | |
| 8,797,704 | B2 | 8/2014 | Ishii et al. | |
| 9,291,356 | B2 | 3/2016 | Demster | |
| 9,441,855 | B2 | 9/2016 | Marks | |
| 9,551,358 | B2 | 1/2017 | Havard, Jr. et al. | |
| 2003/0009969 | A1 * | 1/2003 | Herbeck | E04C 2/292 52/474 |
| 2003/0182873 | A1 * | 10/2003 | Clasen | F24F 13/32 52/73 |
| 2008/0203866 | A1 | 8/2008 | Chamberlain | |
| 2011/0100051 | A1 * | 5/2011 | Edens | F24F 1/0007 62/419 |
| 2012/0193505 | A1 * | 8/2012 | Baron | F16F 15/06 248/636 |
| 2015/0267713 | A1 | 9/2015 | Robinson et al. | |
| 2019/0316808 | A1 * | 10/2019 | Benton | H02G 3/083 |

* cited by examiner

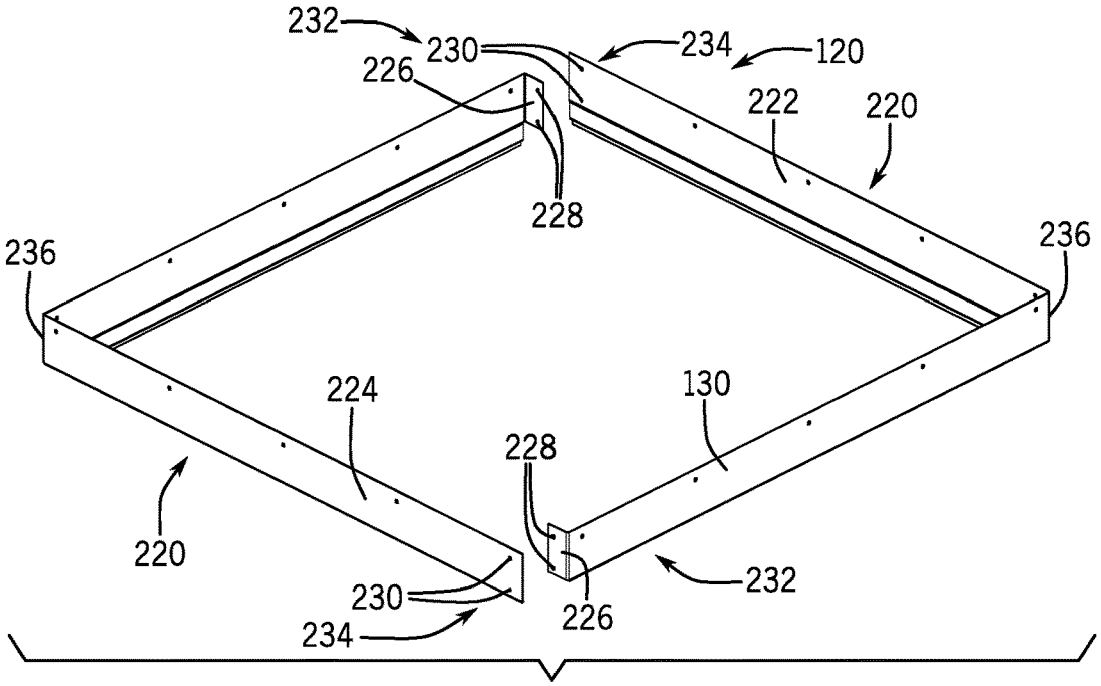
FIG. 10
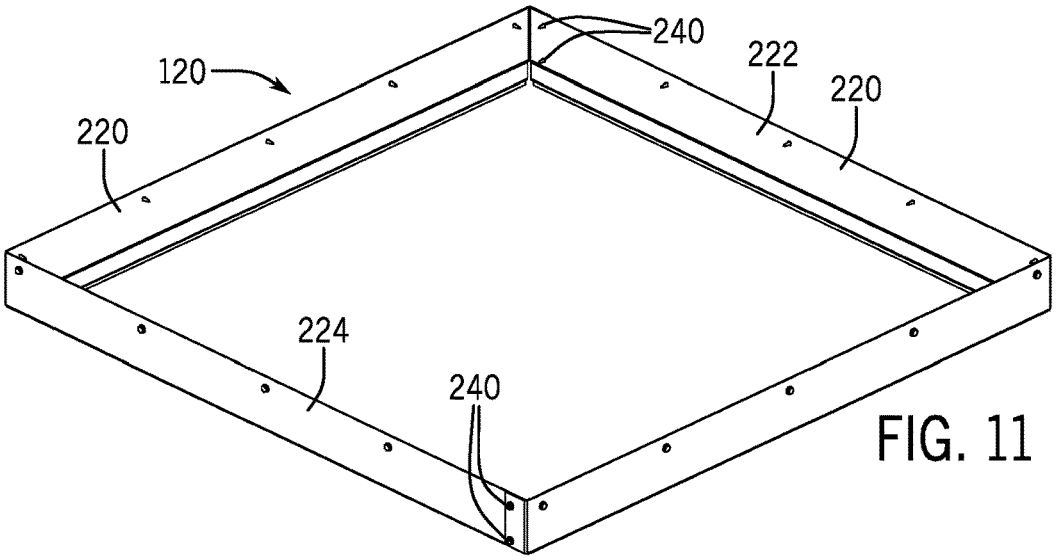
FIG. 11
FIG. 12
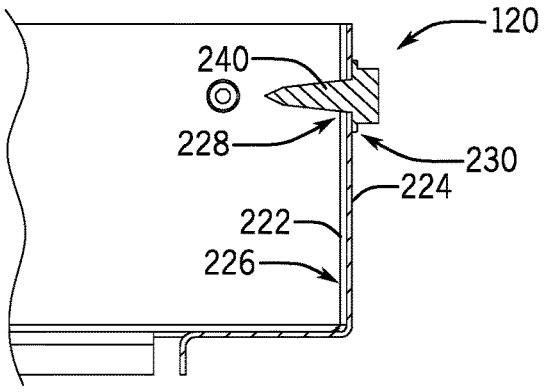

INTERFACE FOR A PLENUM FAN

CROSS REFERENCE TO RELATED APPLICATIONS

This application claims priority from and the benefit of U.S. Provisional Application Ser. No. 62/715,157, entitled "INTERFACE FOR A PLENUM FAN," filed Aug. 6, 2018, which is hereby incorporated by reference in its entirety for all purposes.

BACKGROUND

The present disclosure relates generally to environmental control systems, and more particularly, to an interface for a plenum fan of a heating, ventilation, and air conditioning (HVAC) unit.

Environmental control systems are utilized in residential, commercial, and industrial environments to control environmental properties, such as temperature and humidity, for occupants of the respective environments. The environmental control system may control the environmental properties through control of an airflow delivered to the environment. In some cases, environmental control systems include fans, such as plenum fans, to direct air into or out of ducts that circulate conditioned air within a building or structure to regulate a temperature within the building or structure. In some cases, the fans are coupled to an opening of the duct utilizing fasteners, such as bolts, screws, rivets, or other suitable devices. Unfortunately, connection and/or disconnection of the fan from the duct interface may require a maintenance person to enter the ductwork of the structure and/or otherwise be positioned underneath the fan to access the fasteners and/or openings configured to receive the fasteners. As such, assembly of existing environment control systems may be time consuming and complex, which may increase assembly and/or maintenance costs.

DRAWINGS

FIG. 10 is an exploded perspective view of an embodiment of a bracket of the interface that may be coupled to the fan assembly, in accordance with an aspect of the present disclosure;

FIG. 11 is a perspective view of an embodiment of the bracket configured to be coupled to the fan assembly, in accordance with an aspect of the present disclosure;

FIG. 12 is a cross-sectional view of an embodiment of a fastener coupling segments of the bracket that is configured to be coupled to the fan assembly, in accordance with an aspect of the present disclosure;

SUMMARY

Figure 1:
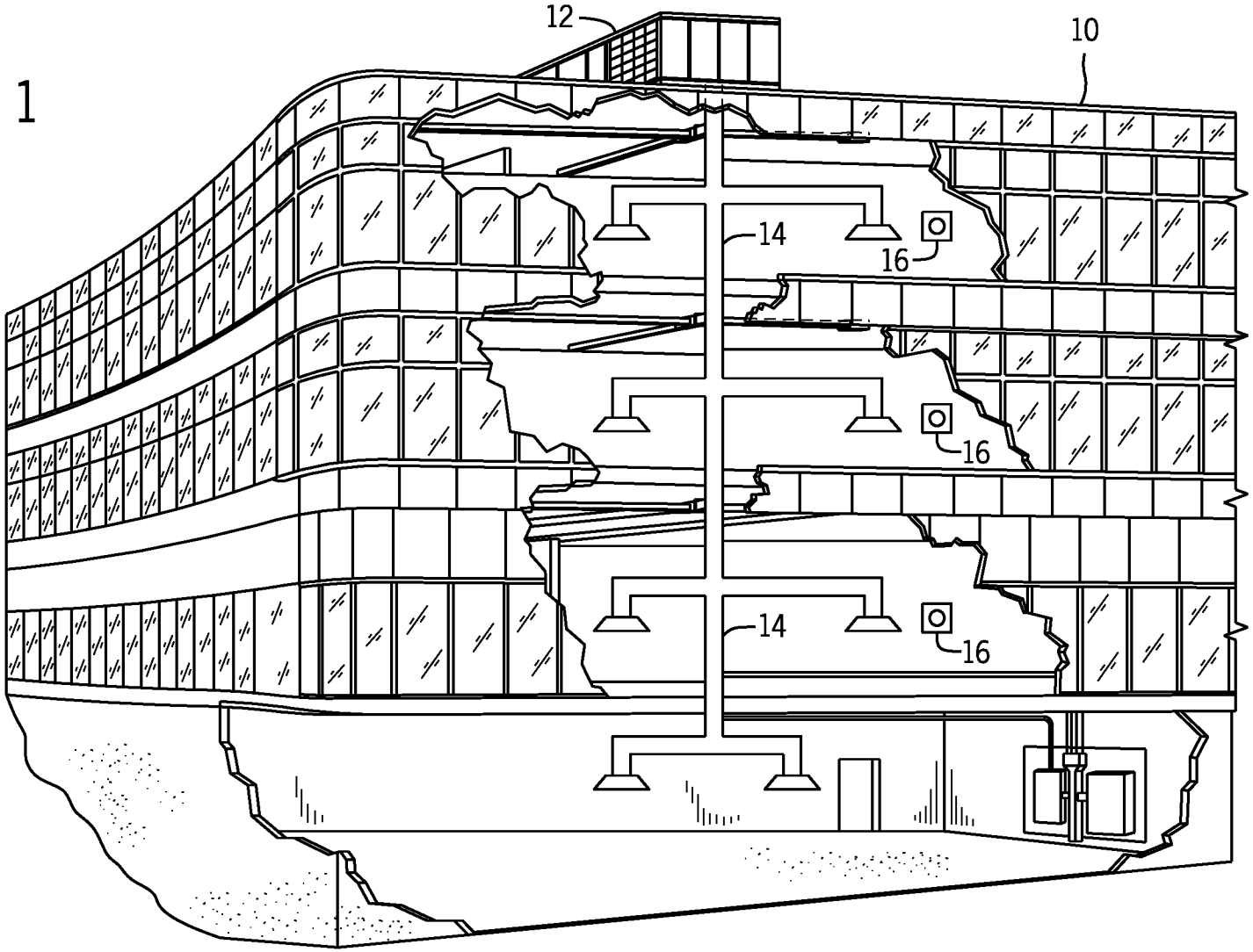
FIG. 1 is a schematic of an embodiment of an environmental control for building environmental management that may employ an HVAC unit, in accordance with an aspect of the present disclosure.

In one embodiment of the present disclosure, an interface for a fan includes a first bracket coupled to the fan, where the fan is configured to direct a flow of air through an opening of a duct, and the opening comprises a central axis extending therethrough, a second bracket coupled to a frame surrounding the opening of the duct, where the first bracket and the second bracket are configured to surround the opening of the duct, the second bracket is configured to support the first bracket, and the second bracket is partially radially within the first bracket relative to the central axis of the opening, and a gasket disposed between the first bracket and the second bracket, where the first bracket, the second bracket, and the gasket are configured to sealingly engage with one another without mechanical securement.

In another embodiment of the present disclosure, a climate management system includes ductwork configured to direct air through a building configured to be conditioned by the climate management system, where the ductwork includes an opening fluidly coupling the ductwork to an ambient environment, and the opening of the ductwork has a central axis extending therethrough, a plenum fan configured to motivate a flow of the air through the ductwork, and an interface between the ductwork and the plenum fan. The interface includes a bracket coupled to the plenum fan and configured to abut a support frame extending about the opening of the ductwork and a seal disposed radially inward from an outer perimeter of the bracket relative to the central axis of the opening, where the seal is configured to block the flow of air from passing through a gap between the bracket and the support frame, and the seal and the bracket are configured to sealingly engage with one another without mechanical securement.

In a further embodiment of the present disclosure, a climate management system includes ductwork configured to direct air through a building configured to be conditioned by the climate management system, where the ductwork includes an opening configured to fluidly couple the ductwork to an ambient environment, a plenum fan configured to motivate a flow of the air through the ductwork, an interface between the ductwork and the plenum fan. The interface includes a seal disposed between the opening of the ductwork and the plenum fan, where the seal is configured to form a sealing interface between the opening and the plenum fan, and where the seal comprises a bulb gasket, a fabric, a bellows, or any combination thereof.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to an improved interface between a fan and ductwork that may be part of a climate management system. Climate management systems may include a fan positioned over an opening that fluidly connects an external environment, such as an ambient environment, to ductwork of a structure, such as a building, that is conditioned by the climate management system. The fan may facilitate a flow of air into or out of the ductwork. As set forth above, existing systems may include an interface that requires a maintenance person to enter the ductwork, or otherwise be positioned beneath the fan, to couple or disconnect the fan from the ductwork. As such, assembly and/or maintenance of existing climate management systems may be complex and time consuming, thereby increasing costs to install or maintain the climate management system.

Accordingly, embodiments of the present disclosure are directed to an improved interface between a fan assembly having a fan, such as a plenum fan, and ductwork of the structure that facilitates simplified and more convenient installation and/or maintenance of the fan, thereby reducing assembly and maintenance costs of the climate management system. For example, a first bracket may be coupled to a base of the fan assembly via a fastener, a weld, an adhesive, and/or another suitable technique. Additionally, a second bracket may be coupled to a frame of the ductwork that defines an opening enabling the fan to direct air into or out of the ductwork. The second bracket may be coupled to the frame of the ductwork via a fastener, a weld, an adhesive, and/or another suitable device or technique. The first bracket may be disposed onto the second bracket, such that the second bracket supports the first bracket and thus the fan assembly. Further still, a sealing member, such as a gasket, a bulb gasket, a fabric, a bellow, a sealant, a foam structure, or any other suitable sealing member is disposed between the first bracket and the second bracket or otherwise between the fan assembly and the frame of the ductwork. As such, air flowing through the interface between the duct and the fan may not leak or flow between the first bracket and the second bracket. In some embodiments, the first bracket includes a lip that is configured to secure the sealing member between the first bracket and the second bracket. In any case, the improved interface between the fan and the ductwork may facilitate simplified and improved assembly or disassembly of the climate management system, thereby reducing assembly costs and/or maintenance costs.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
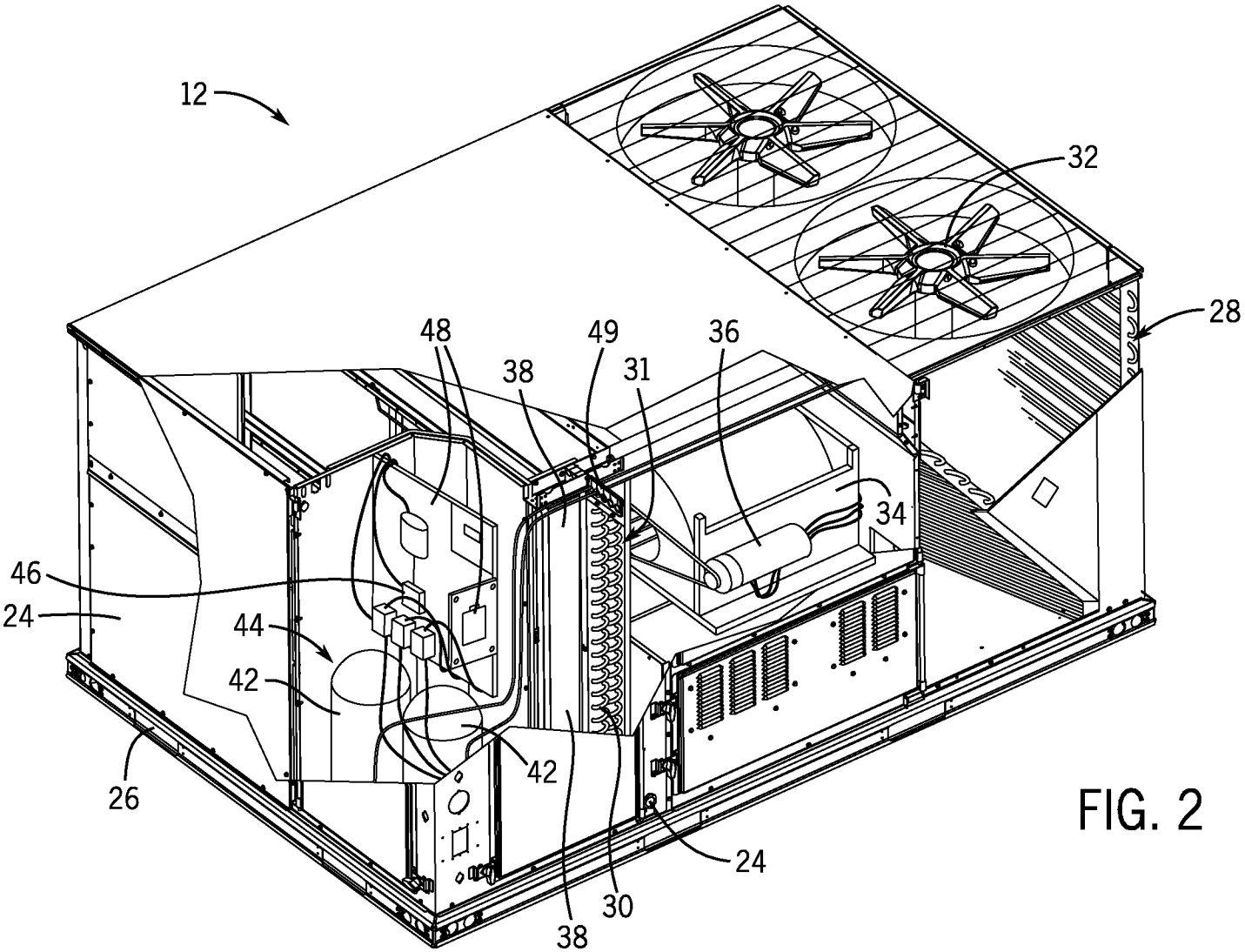
FIG. 2 is a perspective view of an embodiment of an HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
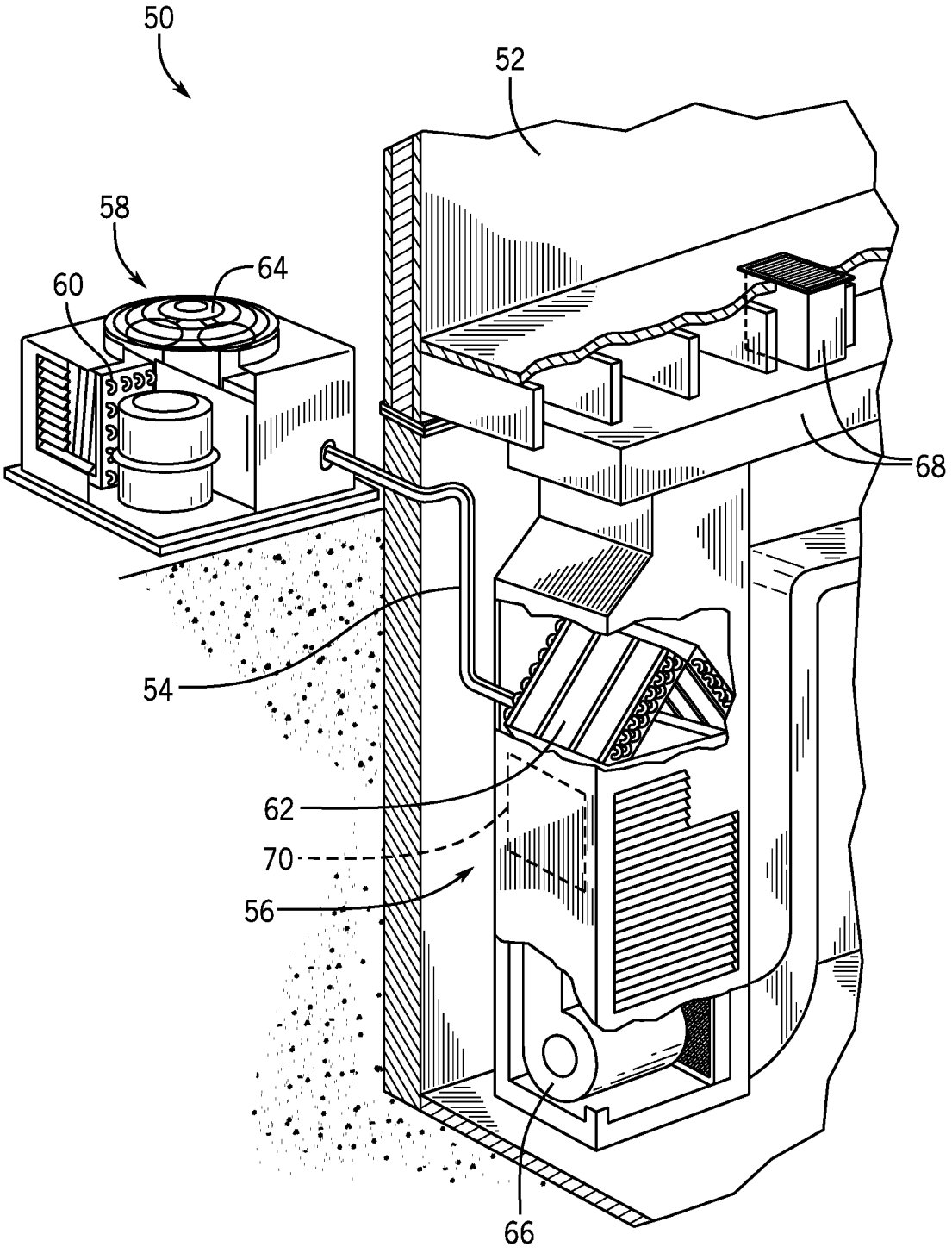
FIG. 3 is a schematic of an embodiment of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
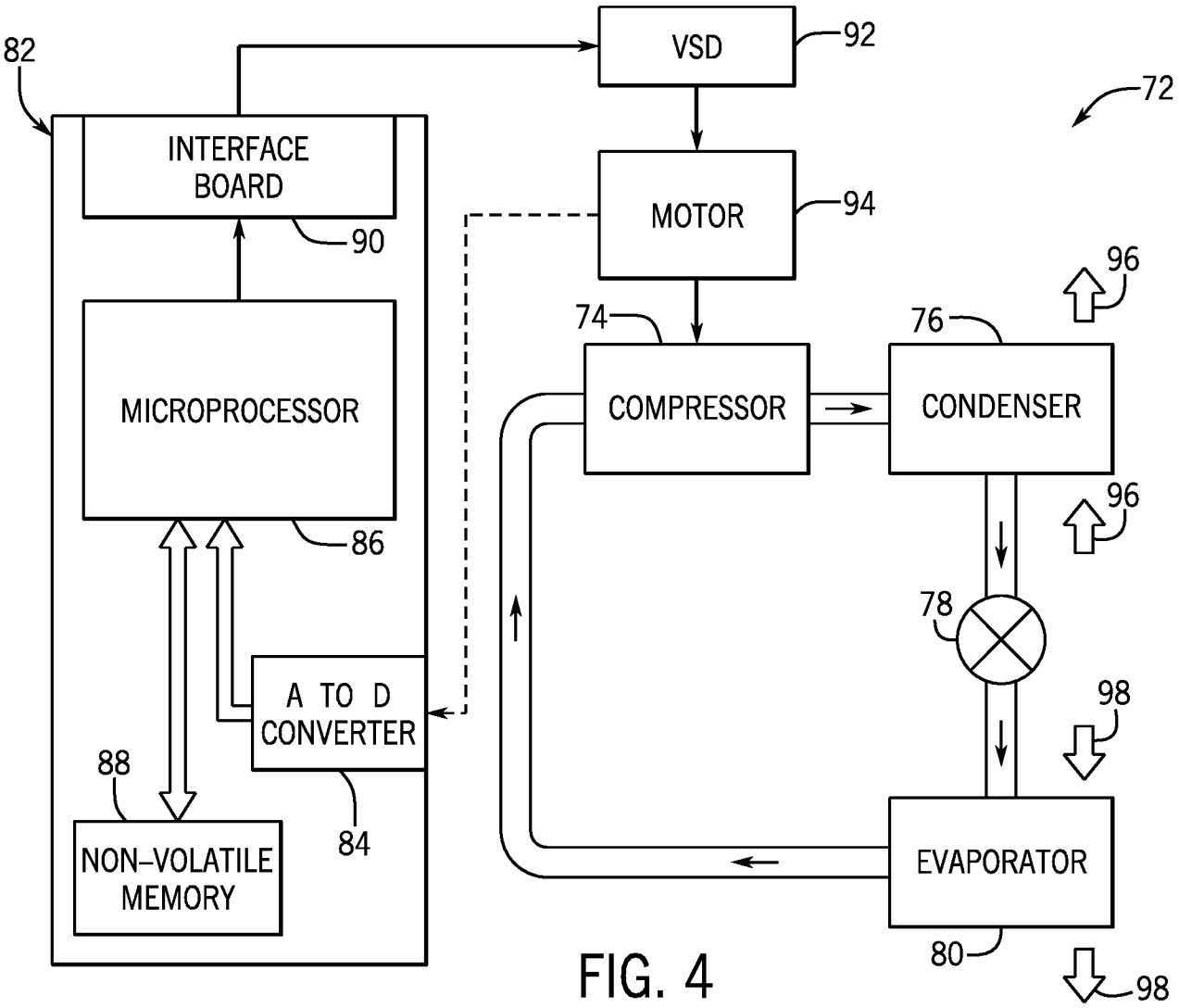
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to an improved interface between a fan assembly of a climate management system and a duct, or other passageway, of the climate management system. The improved interface may be utilized with the HVAC unit 12, the residential heating and cooling system 50, or another suitable climate management system. As should be understood, the fan assembly may include a fan, such as a plenum fan, which may facilitate a flow of air between the duct or other passageway and an ambient environment. For example, the fan may be configured to direct a flow of air from the duct or passageway into the ambient environment, such that the flow of air is exhausted from a building conditioned by the climate management system. In other embodiments, the fan may be configured to direct air into the duct or passageway as supply air. The supply air may be directed across a heat exchanger of the climate management system to treat the supply air. As such, conditioned air is provided to various locations or spaces within the building via the duct or other passageway. The improved interface may facilitate forming a seal between the fan assembly of the climate management system and a frame of the duct or other passageway. As such, air flowing into or out of the duct may not leak or otherwise flow between an interface connecting the duct and the fan. Further, the improved interface between the fan and the ductwork may facilitate improved assembly or disassembly of the climate management system, thereby reducing assembly costs and/or maintenance costs.

Figure 5:
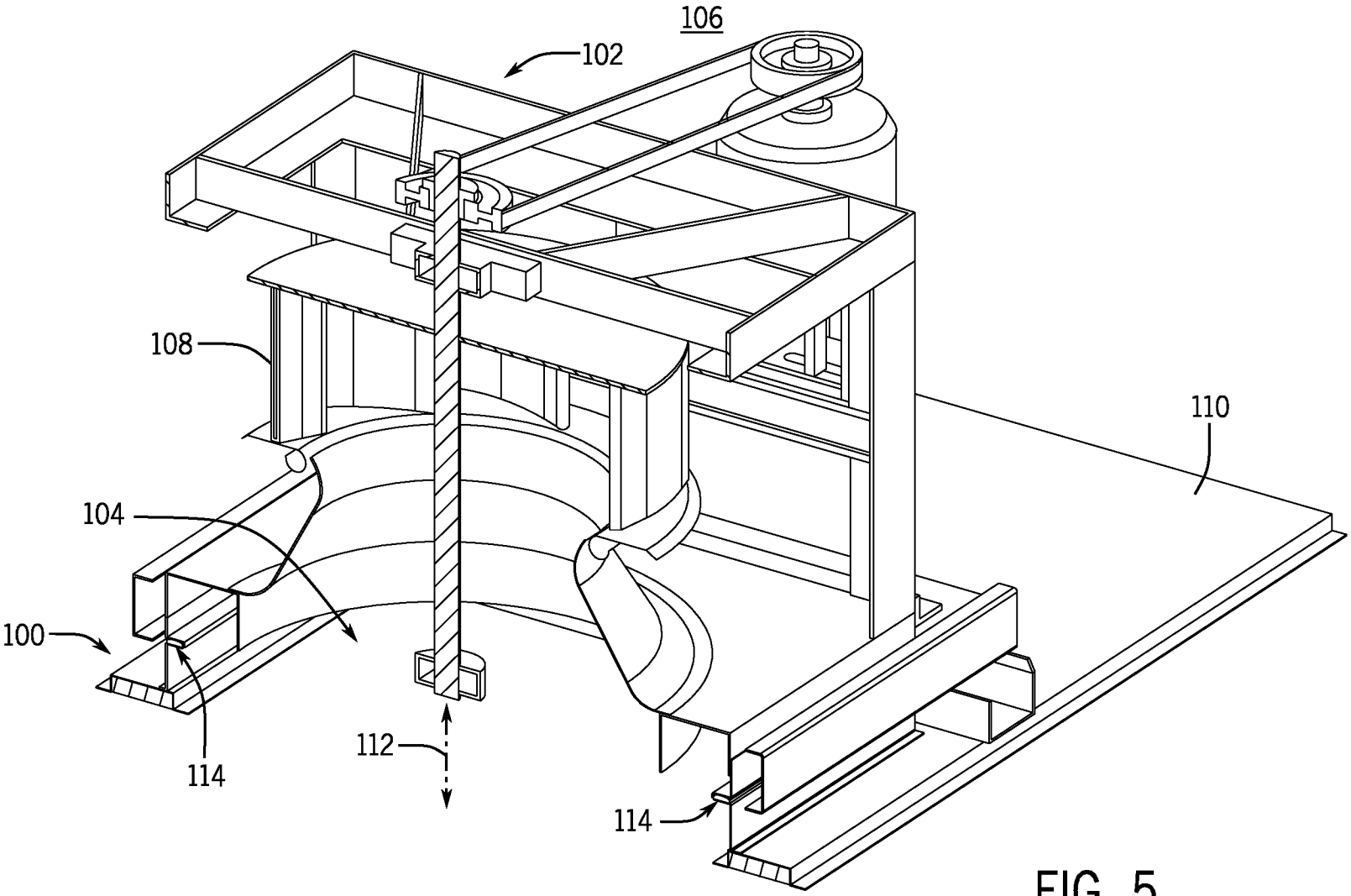
FIG. 5 is a cross-sectional perspective view of an embodiment of an interface for a fan assembly that may be utilized with the systems of FIGS. 1-3, in accordance with an aspect of the present disclosure.

FIG. 5 is a cross-sectional perspective view of an embodiment of an interface 100 between a fan assembly 102 and an opening 104, which may fluidly couple ductwork, such as the ductwork 14 or another passageway, to an ambient environment 106. For example, in some embodiments, the fan assembly 102 includes a fan 108, such as a plenum fan, that is configured to direct a flow of air from the ambient environment 106 into the ductwork 14 as supply air. In other embodiments, the fan 108 is configured to direct a flow of air from out of the ductwork 14 and into the ambient environment 106 as exhaust air. In any case, the interface 100 may facilitate a connection, such as a seal, between the fan assembly 102 and a frame 110, or other structure, that surrounds the opening 104. In some embodiments, the interface 100 may enable the fan assembly 102 to be disposed on top of the frame 110 with respect to a central axis 112 of the opening 108. The fan assembly 102 may not be coupled to or secured to the frame 110 via fasteners, welds, adhesives, clamps, or other securement features. Instead, the fan assembly 102 may rest on top of the frame 110 or a structural component coupled to the frame 110. Further, a sealing member 114 may be disposed between the fan assembly 102 and the frame 110 to form a seal between the fan assembly 102 and the frame 110. In other words, a direct physical connection or mechanical securement between the fan assembly 102 and the frame 110 may not be formed to create the seal at the interface 100. As used herein, a physical connection or mechanical securement includes a technique that fixedly couples the fan assembly 102 to the frame 110, such as a fastener, a weld, a clamp, an adhesive, or another suitable technique.

Figure 6:
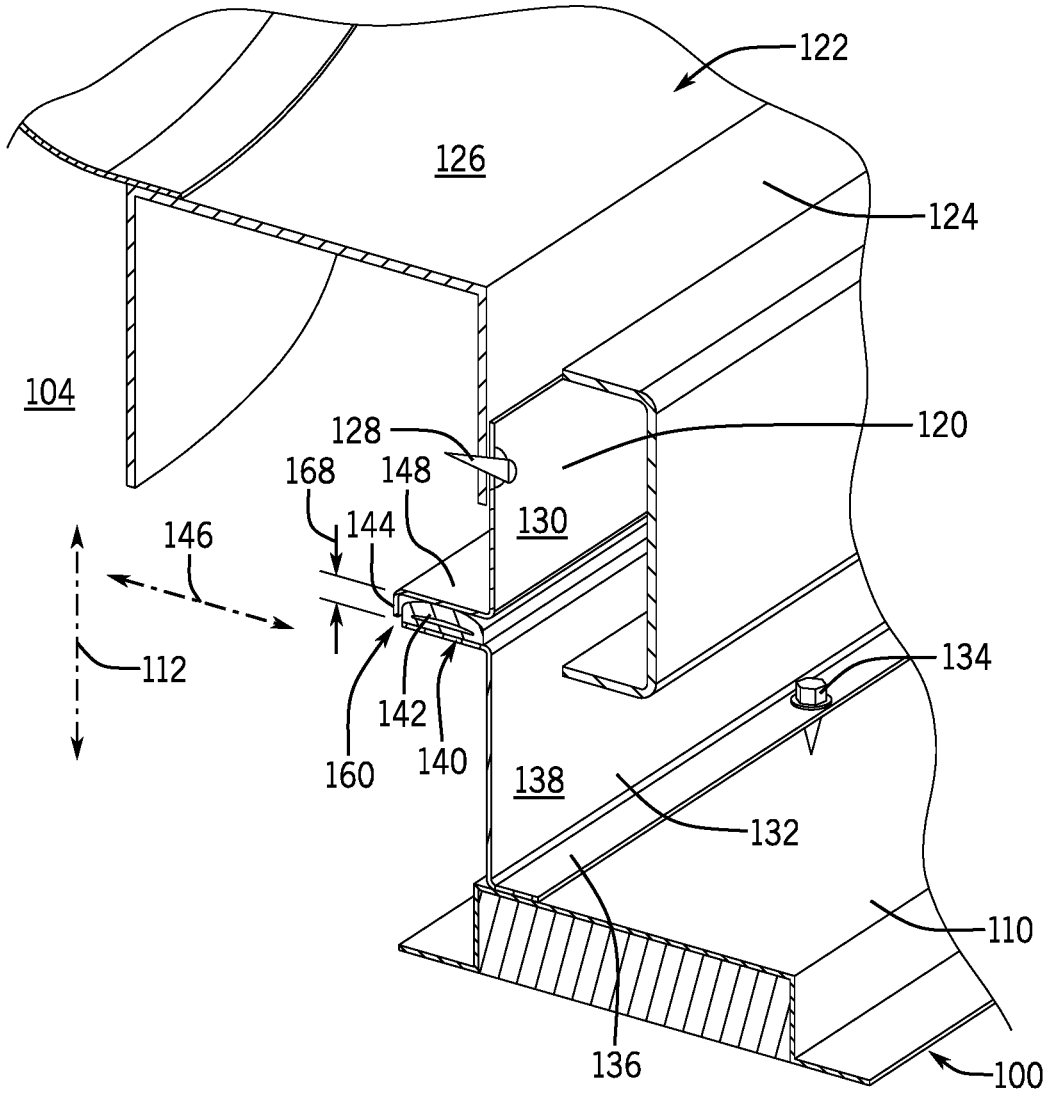
FIG. 6 is a partial cross-sectional perspective view of an embodiment of the interface for the fan assembly, in accordance with an aspect of the present disclosure.

For example, FIG. 6 is a partial perspective view of the interface 100. As shown in the illustrated embodiment of FIG. 6, the interface 100 includes a first bracket 120 coupled to a base 122 of the fan assembly 102. The base 122 may include a substantially box-shaped or rectangular prism structure, such that a flange 124 of the base 122 extends from a support plate 126 of the base 122 in a direction along which the central axis 112 extends. In some embodiments, the flange 124 is substantially crosswise to the support plate 126. In other embodiments, the flange 124 and the support plate 126 may form any suitable angle with respect to the central axis 112. In any case, the first bracket 120 is coupled to the flange 124 of the base 122 via a fastener 128, which extends through a coupling portion 130 of the first bracket 120 and into the flange 124. In some embodiments, the coupling portion 130 of the first bracket 120 and the flange 124 may include pre-fabricated openings configured to receive the fastener 128. In other embodiments, the fastener 128 may be disposed through the coupling portion 130 of the first bracket 120 and through the flange 124 to form an opening.

Further, the interface 100 includes a second bracket 132, which is disposed beneath the first bracket 120 with respect to the central axis 112. As discussed in further detail herein, the second bracket 132 is coupled to the frame 110 surrounding the opening 104 via a fastener 134 or a second fastener. As shown in the illustrated embodiment of FIG. 6, the second bracket includes a first flange 136, a body portion 138, and a second flange 140. The first flange 136 is configured to abut a surface of the frame 110, such that the fastener 134 extends through the first flange 136 and into the frame 110 to secure the second bracket 132 to the frame 110. Further, the second flange 140 of the second bracket 132 is configured to receive and support a sealing member 142. In some embodiments, the sealing member 142 includes a gasket, such as a bulb gasket, that is configured to block a flow of air between the first bracket 120 and the second bracket 132 and form a seal at the interface 100. In some embodiments, the first bracket 120 includes a lip member 144 configured to block movement of the sealing member 142 along an axis 146, such as a lateral axis of the interface 100. Accordingly, the sealing member 142 is captured and secured between the first bracket 120 and the second bracket 132 to maintain the seal at the interface 100.

As shown in the illustrated embodiment of FIG. 6, the lip member 144 of the first bracket 120 extends from a body portion 148 of the first bracket 120. The body portion 148 may be disposed between the lip member 144 and the coupling portion 130 of the first bracket 120. In some embodiments, the lip member 144 and the coupling portion 130 extend along a direction of the central axis 112, and the body portion 148 extends in a direction along the axis 146. As such, the lip member 144 and the coupling portion 130 may each extend substantially crosswise from the body portion 148. In other embodiments, the lip member 144 and the coupling portion 130 may form any suitable angle with the body portion 148 with respect to the axes 112, 146. Similarly, the first flange 136 and the second flange 140 of the second bracket 132 may extend in a direction along the axis 146, and the body portion 138 of the second bracket 132 may extend in a direction along the central axis 112. As such, the first flange 136 and the second flange 140 may each extend substantially crosswise from the body portion 138. In other embodiments, the first flange 136 and the second flange 140 may form any suitable angle with the body portion 138 with respect to the axes 112, 146.

Figure 7:
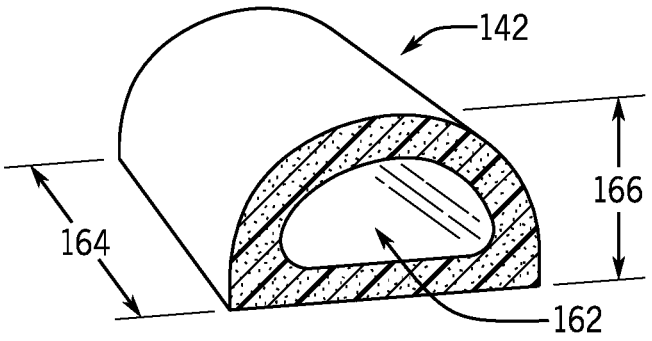
FIG. 7 is a perspective view of an embodiment of a sealing member of the interface, in accordance with an aspect of the present disclosure.

The sealing member 142 may include a resilient material that partially compresses when the first bracket 120 is positioned onto the second bracket 132. For instance, the sealing member 142 may compress and substantially fill a gap 160 between the first bracket 120 and the second bracket 132. For example, FIG. 7 is a perspective view of an embodiment of the sealing member 142, where the sealing member 142 includes a bulb gasket. As shown in the illustrated embodiment of FIG. 7, the bulb gasket 142 may include a semi-circular cross-sectional shape having an opening or cavity 162 extending along a length 164 of the bulb gasket 142. Accordingly, as a weight of the fan assembly 102 is applied to the bulb gasket 142, the bulb gasket 142 may partially compress and expand within the gap 160 between the first bracket 120 and the second bracket 132. Further, the bulb gasket 142 may include a height 166 that is greater than a length 168 of the lip member 144, as shown in FIG. 6. The height 166 of the bulb gasket 142 may be between 0.1 inches and 2 inches, between 0.25 inches and 1.25 inches, or between 0.5 inches and 1 inch. In any case, the bulb gasket 142 may include any suitable height 166 that enables the bulb gasket 142 to compress and form a seal when the first bracket 120 is positioned on the second bracket 132. As noted above, the sealing member 142 may include any suitable material or component that substantially blocks a flow of air between the first bracket 120 and the second bracket 132, such as a gasket, a fabric, a bellow, a sealant, a foam structure, or any other suitable sealing member.

Figure 8:
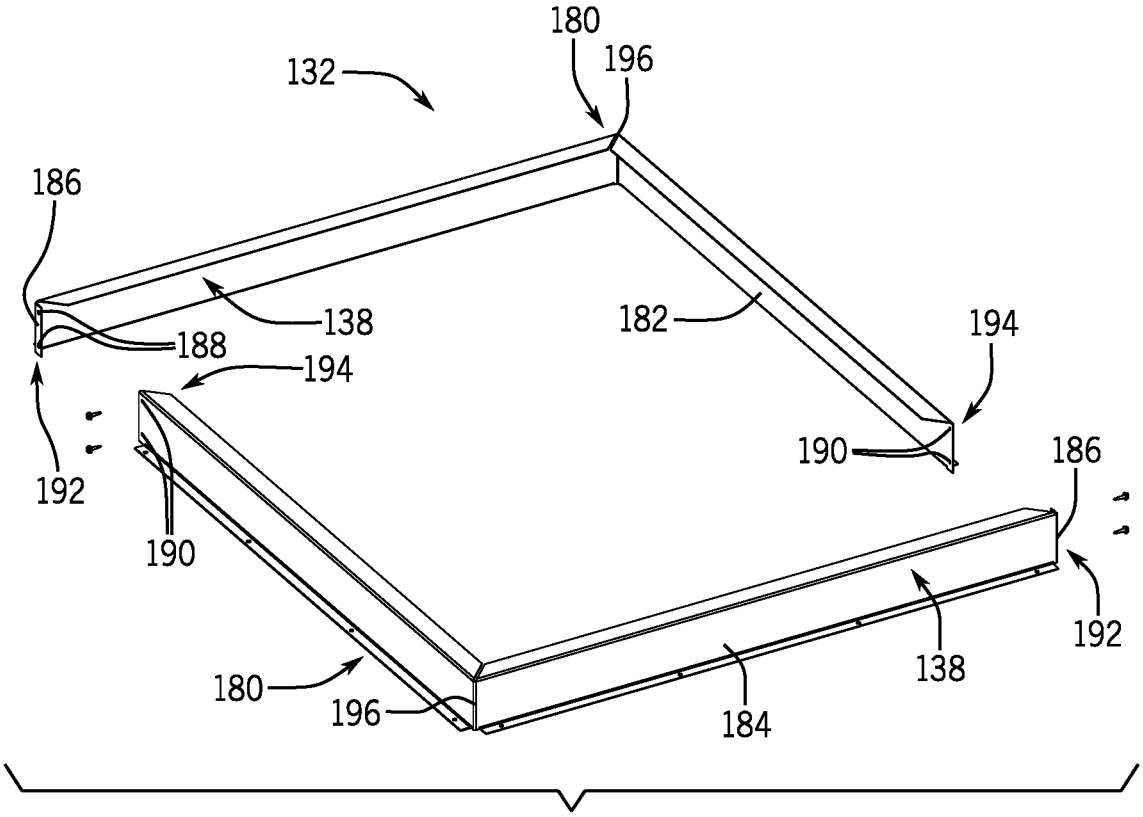
FIG. 8 is an exploded perspective view of an embodiment of a bracket of the interface that may be coupled to a frame defining a ductwork opening, in accordance with an aspect of the present disclosure.
Figure 9:
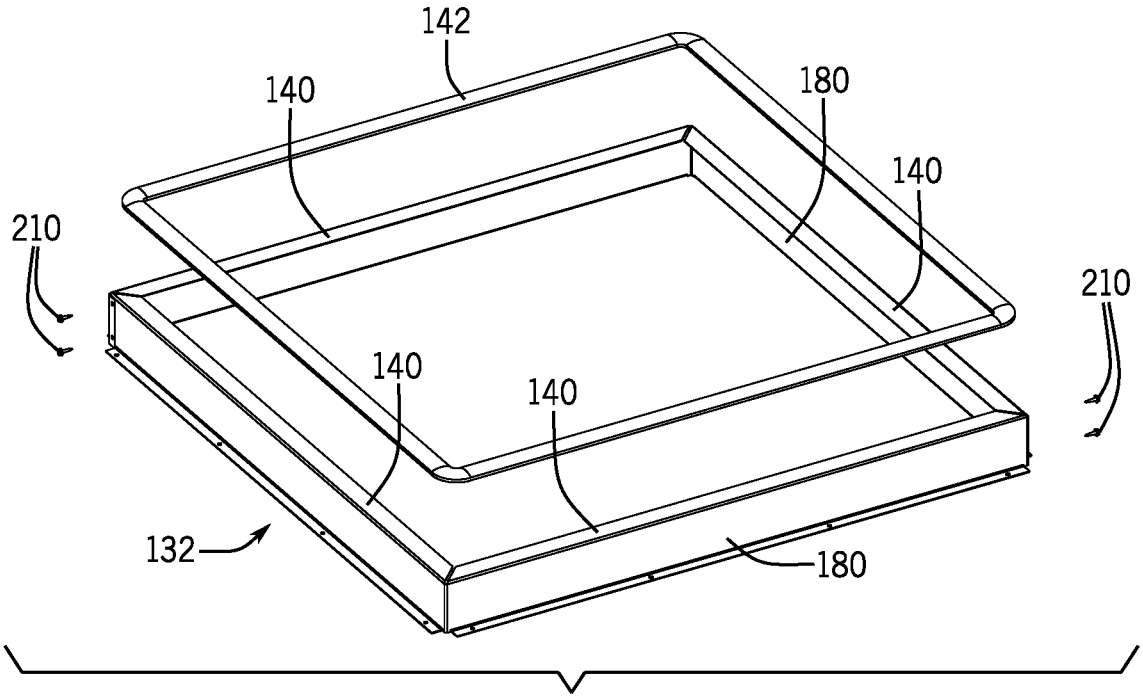
FIG. 9 is an exploded perspective view of an embodiment of the bracket and the sealing member of the interface, in accordance with an aspect of the present disclosure.

In some embodiments, the first bracket 120 and/or the second bracket 132 of the interface 100 may include multiple segments that are coupled to one another and to the flange 124 and the frame 110, respectively. For example, FIGS. 8 and 9 are perspective views of segments 180 that cooperatively form the second bracket 132. For example, FIG. 8 is an exploded view of a first segment 182 and a second segment 184, which may be coupled to one another to form the second bracket 132. In some embodiments, the segments 180 may be self-similar in that each segment 182 is substantially the same in geometry and configuration. While the illustrated embodiment of FIG. 8 shows the second bracket 132 as having two segments 180 that form a substantially square or box shape, in other embodiments, the second bracket 132 may include one, three, four, five, six, seven, eight, nine, ten, or more than ten segments 180 that form any suitable shape to cooperatively form the second bracket 132.

As shown in the illustrated embodiment of FIG. 8, the first segment 182 may include a coupling tab 186 extending from the body portion 138 of the first segment 182. The coupling tab 186 may include openings 188 that are configured to align with corresponding openings 190 in the body portion 138 of the second segment 184. Additionally, the second segment 184 may also include the coupling tab 186 extending from the body portion 138 of the second segment 184. The coupling tab 186 includes the openings 188 configured to align with the corresponding openings 190 in the body portion 138 of the first segment 182. Each of the segments 180 may thus include the coupling tab 186 on a first end 192 and the corresponding openings 190 formed in the body portion 138 on a second end 194. Further, the segments 180 may include a joint, an angle, or a junction 196 between the first end 192 and the second end 194, such that the segments 180 are non-linear.

The first and second segments 182, 184 may be coupled to one another by fasteners 210, as shown in FIG. 9. For instance, fasteners 210 may be disposed into the openings 188 and the corresponding openings 190 in order to secure and couple the first and second segments 182, 184 to one another, thereby forming the second bracket 132. Accordingly, the second bracket 132 may be coupled to the frame 110 as a single component. Additionally, the sealing member 142 may be disposed onto the second flange 140 of the second bracket 132 and include substantially the same shape or geometry as the second bracket 132. For example, as shown in the illustrated embodiment of FIG. 9, the sealing member 142 includes a square or rectangular shape that conforms to the shape of the second bracket 132. In other embodiments, the bulb gasket 142 may include a circular, elliptical, polygonal, or other suitable shape to match the geometry of the second bracket 132 and form a seal between the first bracket 120 and the second bracket 132.

Similar to the second bracket 132, the first bracket 120 may also include multiple segments 220 that cooperatively form the first bracket 120. For example, FIGS. 10 and 11 are perspective views of the segments 220 that form the first bracket 120. For example, FIG. 10 is an exploded perspective view of a first segment 222 and a second segment 224, which may be coupled to one another to form the first bracket 120. In some embodiments, the segments 220 may be self-similar in that each segment 220 is substantially the same in geometry and configuration. While the illustrated embodiment of FIG. 10 shows the first bracket 120 as having two segments 220 that form a substantially square or box shape, in other embodiments, the first bracket 120 may include one, three, four, five, six, seven, eight, nine, ten, or more than ten segments that form any suitable shape.

As shown in the illustrated embodiment of FIG. 10, the first segment 222 may include a coupling tab 226 extending from the coupling portion 130 of the first segment 222. The coupling tab 226 may include openings 228 that are configured to align with corresponding openings 230 in the coupling portion 130 of the second segment 224. Additionally, the second segment 224 may also include the coupling tab 226 extending from the coupling portion 130 of the second segment 224. The coupling tab 226 includes the openings 228 configured to align with the corresponding openings 230 in the coupling portion 130 of the first segment 222. Each of the segments 220 may thus include the coupling tab 226 on a first end 232 and the corresponding openings 230 formed in the coupling portion 130 on a second end 234. Further, the segments 220 may include a joint, an angle, or a junction 236 between the first end 232 and the second end 234, such that the segments 220 are non-linear.

The first and second segments 222, 224 may be coupled to one another by fasteners 240, as shown in FIG. 11. For instance, fasteners 240 may be disposed into the openings 228 and the corresponding openings 230 in order to secure and couple the first and second segments 222, 224 to one another, thereby forming the first bracket 120. Accordingly, the first bracket 120 may be coupled to the fan assembly 102 as a single component.

FIG. 12 is a partial cross-sectional view of an embodiment of the first bracket 120 showing the fasteners 240 extending through the openings 228 and the corresponding openings 230 to couple the first segment 222 and the second segment 224 to one another. As shown in the illustrated embodiment of FIG. 12, the fasteners 240 include rivets. In other embodiments, the fasteners 240 may include screws, bolts, adhesives, or another suitable securement device.

Figure 13:
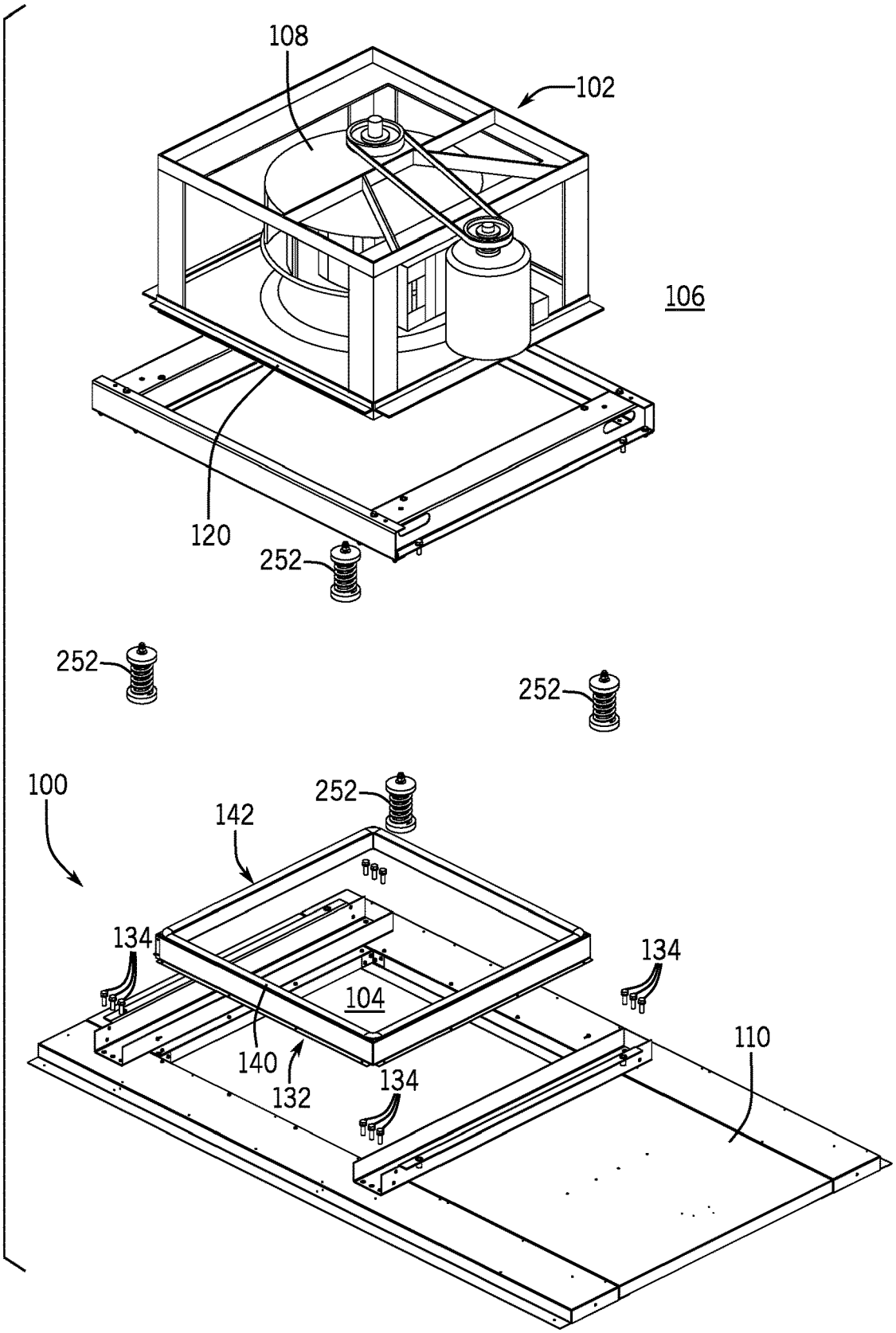
FIG. 13 is an exploded perspective view of an embodiment of the interface for the fan assembly, in accordance with an aspect of the present disclosure.

FIG. 13 is an exploded perspective view of an embodiment of the first bracket 120 and the second bracket 132 of the interface 100. As shown in the illustrated embodiment of FIG. 13, the frame 110 surrounds the opening 104 fluidly coupling the ductwork 14 to the ambient environment 106 external to the building 10. The second bracket 132 is secured to the frame 110 via the fasteners 134, such as screws, bolts, rivets, or other suitable fasteners. The sealing member 142 may be disposed on the second flange 140 of the second bracket 132. As such, the fan assembly 102, as well as the first bracket 120 coupled to the fan assembly 102, may be disposed onto the sealing member 142, such that the second bracket 132 supports the fan assembly 102 and the first bracket 120. Further, in some embodiments, damping devices 252 may be disposed between the fan assembly 102 and the frame 110 to reduce a transfer of vibrational energy from the fan 108 of the fan assembly 102 to the frame 110. In other words, the damping devices 252 may absorb vibrational energy generated by the fan 108 and reduce an amount of vibrational energy that is ultimately transferred to the frame 110. In any case, the first bracket 120 coupled to the fan assembly 102 may be positioned on top of the sealing member 142 and the second bracket 132, such that a direct physical connection between the fan assembly 102 and the frame 110 is not utilized to form and seal the interface 100.

Figure 14:
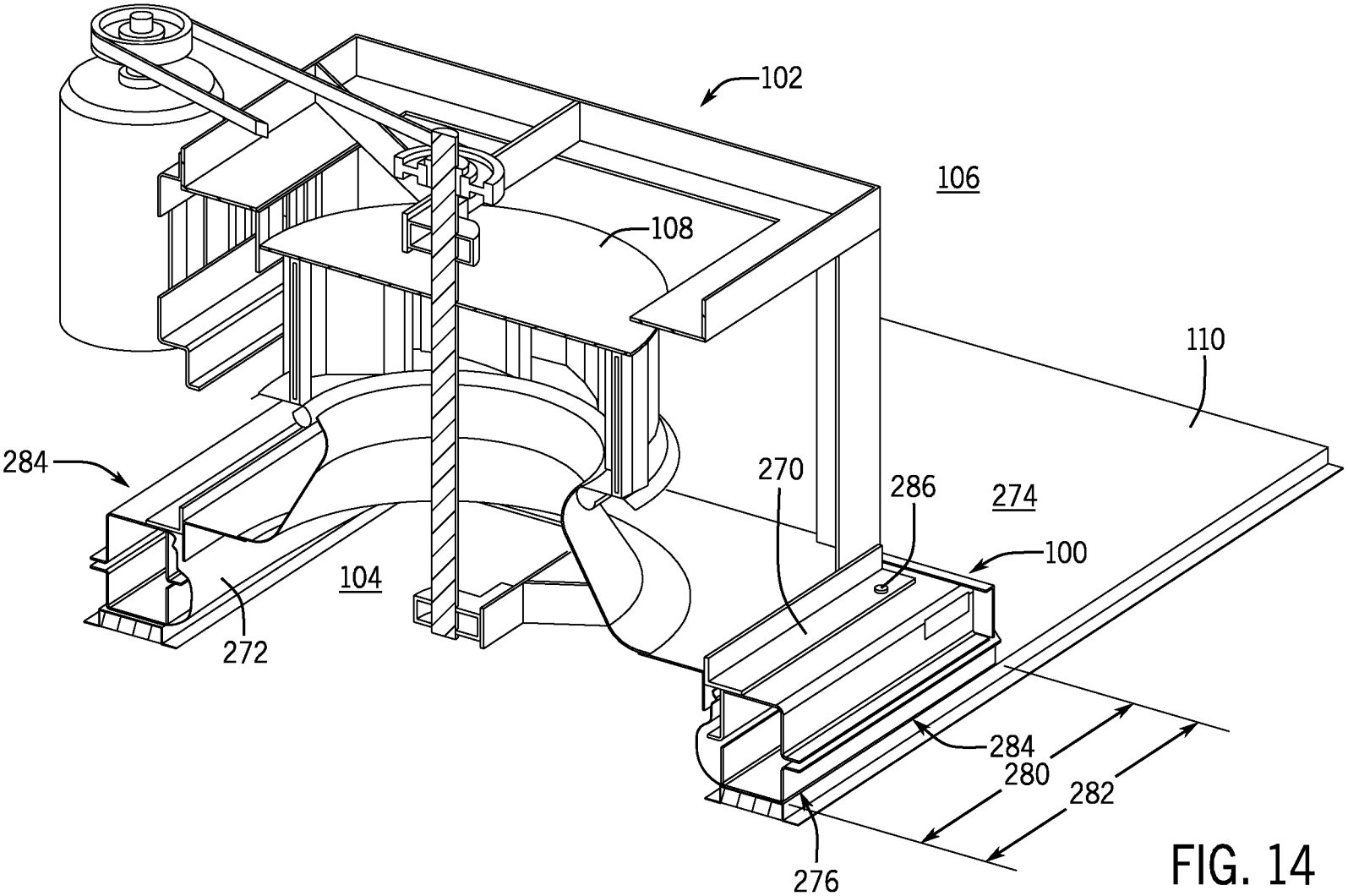
FIG. 14 is a cross-sectional perspective view of an embodiment of the interface for the fan assembly having a fabric, in accordance with an aspect of the present disclosure.

While the discussion above focuses on the interface 100 having the first bracket 120, the second bracket 132, and the sealing member 142, in other embodiments, the interface 100 may include a bracket 270 coupled to the fan assembly 102 that is disposed over fabric 272 coupled to the frame 110. For example, FIG. 14 is a perspective view of an embodiment of the interface 100 where the bracket 270 is positioned onto the fabric 272. As shown in the illustrated embodiment of FIG. 14, the fabric 272 may be positioned onto the frame 110 and extend from a base 274 of the frame 110 and around a support structure 276 of the frame 110 used to support the fan assembly 102. In some embodiments, the fabric 272 includes a canvas material, a polymeric material, and/or another suitable material that may facilitate a seal between the frame 110 and the bracket 270. Additionally or alternatively, the fabric 272 may include a single sheet of fabric 272 that includes an opening configured to align with the opening 104 of the frame 110. In other embodiments, the fabric 272 may include multiple sheets of fabric 272 that are between 5 inches and 15 inches wide and include a length 280 that corresponds to a length 282 of corresponding sides 284 of the opening 104. In any case, the width of the fabric 272 may be configured to extend from the base 274 of the frame 110 and around the support structure 276, such that the bracket 270 may be disposed on the support structure 276 with the fabric 272 disposed between the bracket 270 and a surface of the support structure 276. In some embodiments, the bracket 270 is coupled to the support structure 276 via fasteners 286.

Figure 15:
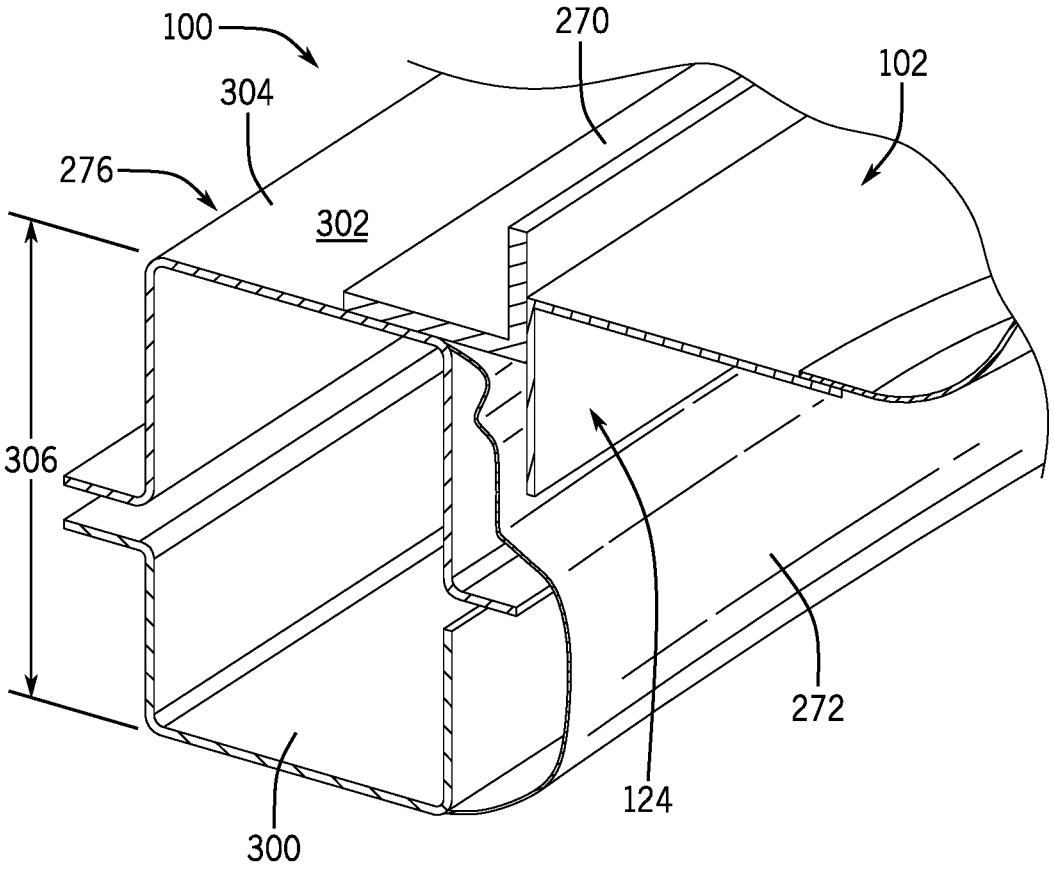
FIG. 15 is a partial cross-sectional perspective view of an embodiment of the interface having the fabric, in accordance with an aspect of the present disclosure.

FIG. 15 is a partial cross-sectional perspective view of the embodiment of the interface 100 of FIG. 14. As shown in the illustrated embodiment of FIG. 15, the fabric 272 extends from beneath a first portion 300 of the support structure 276 and onto a surface 302 of a second portion 304 of the support structure 276. As such, the fabric 272 extends along a total height 306 of the first and second portions 300, 304 of the support structure 276. Further, the bracket 270 is coupled to the flange 124 of the fan assembly 102 and is configured to be positioned onto the fabric 272 disposed on the surface 302 of the second portion 304 of the support structure 276. Accordingly, the fabric 272 forms a seal between the bracket 270 and the support structure 276, such that air flowing through the opening 104 is substantially blocked from flowing between the bracket 270 and the support structure 276 or through the first and second portions 300 and 304 of the support structure 276. As discussed above with respect to the sealing member 142, the fabric 272 may facilitate installation of the fan assembly 102 because the fan assembly 102 may be disposed onto the support structure 276 to form the seal. In some embodiments, the bracket 270 may further be secured to the support structure 276 via the fasteners 286. However, the seal may be formed between the fan assembly 102 and the support structure 276 without the fasteners 286.

Figure 17:
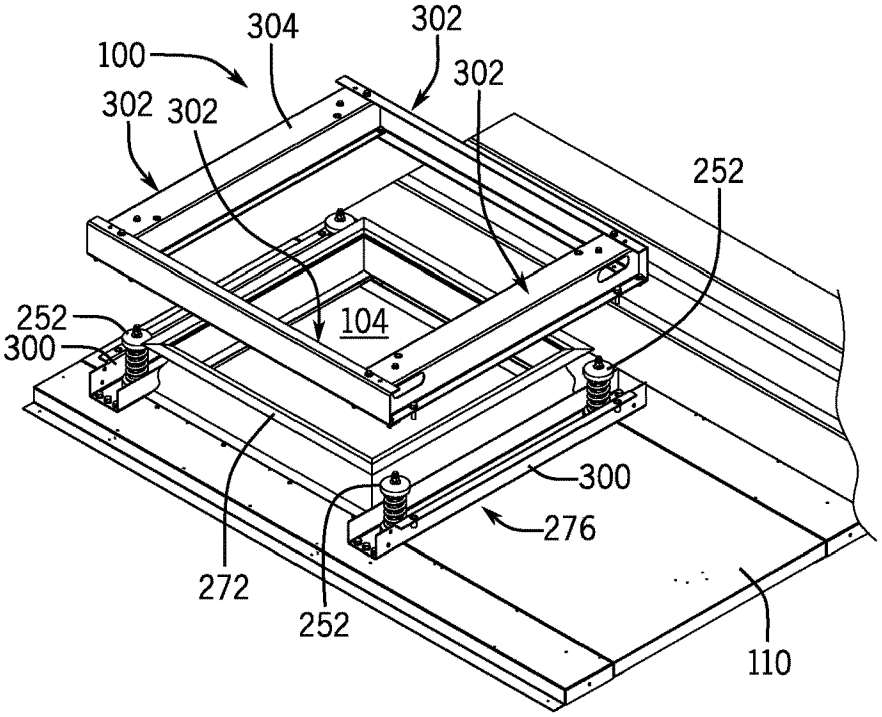
FIG. 17 is an exploded perspective view of an embodiment of the interface having the fabric during assembly, in accordance with an aspect of the present disclosure.
Figure 16:
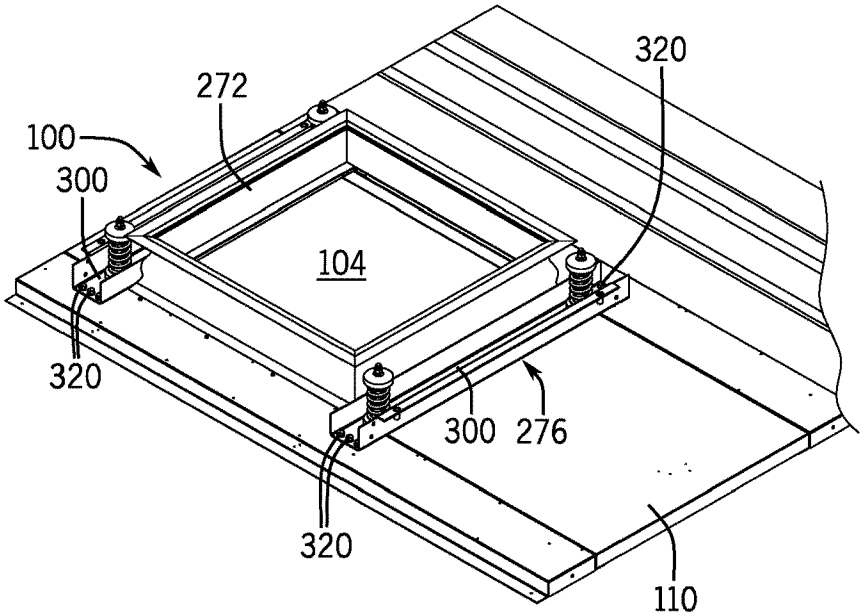
FIG. 16 is a perspective view of an embodiment of the interface having the fabric during assembly, in accordance with an aspect of the present disclosure.
Figure 18:
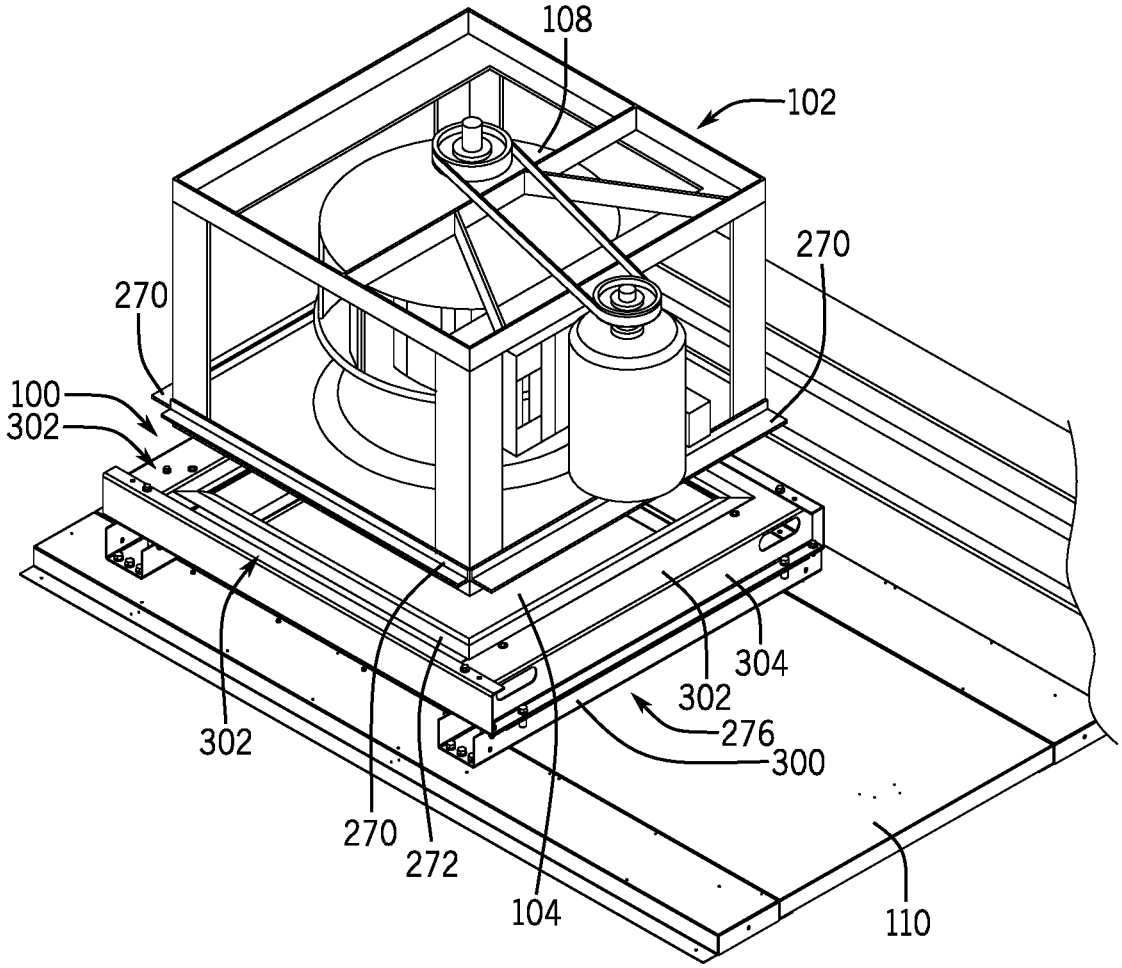
FIG. 18 is an exploded perspective view of an embodiment of the interface having the fabric during assembly, in accordance with an aspect of the present disclosure.

FIGS. 16-18 illustrate an assembly process for forming the interface 100 having the bracket 270, the fabric 272, and the support structure 276. For example, as shown in the illustrated embodiment of FIG. 16, the fabric 272 may be disposed onto the frame 110 surrounding the opening 104. In some embodiments, the fabric 272 is secured to the frame 110 via an adhesive, fasteners, or another suitable coupling technique. Once the fabric 272 is secured to the frame 110, the first portion 300 of the support structure 276 may be disposed onto the fabric 272 and may be coupled to the frame 110 via one or more fasteners 320. In some embodiments, the fabric 272 is not secured to the frame 110 via a separate component, such as the adhesive or fasteners, but instead secured to the frame 110 via a force applied to the fabric 272 from the first portion 300 of the support structure 276. In any case, the fabric 272 is positioned between the frame 110 and the first portion 300 of the support structure 110.

As shown in the illustrated embodiment of FIG. 17, the second portion 304 of the support structure 276 may be coupled to the first portion 300 of the support structure 276. In some embodiments, the damping devices 252 are disposed between the first portion 300 and the second portion 304 of the support structure 276. In any case, the fabric 272 may extend from the frame 110 and above the second portion 304 of the support structure 276, such that the fabric 272 may be positioned on the surface 302 of the second portion 304 of the support structure 276. For example, FIG. 18 is an exploded perspective view of the fabric 272 disposed on the surface 302 of the second portion 304 of the support structure 276. In some embodiment, the fabric 272 is secured to the surface 302 via an adhesive, fasteners, or another suitable coupling device. In other embodiments, the fabric 272 is disposed onto the surface 302 and secured to the surface 302 via a force applied to the fabric 272 from the bracket 270 coupled to the fan assembly 102. In any case, the fabric 272 forms a seal between the frame 110 and the fan assembly 102 to block a flow of air from exiting the opening 104 via a gap between the frame 110 and the fan assembly 102.

Figure 19:
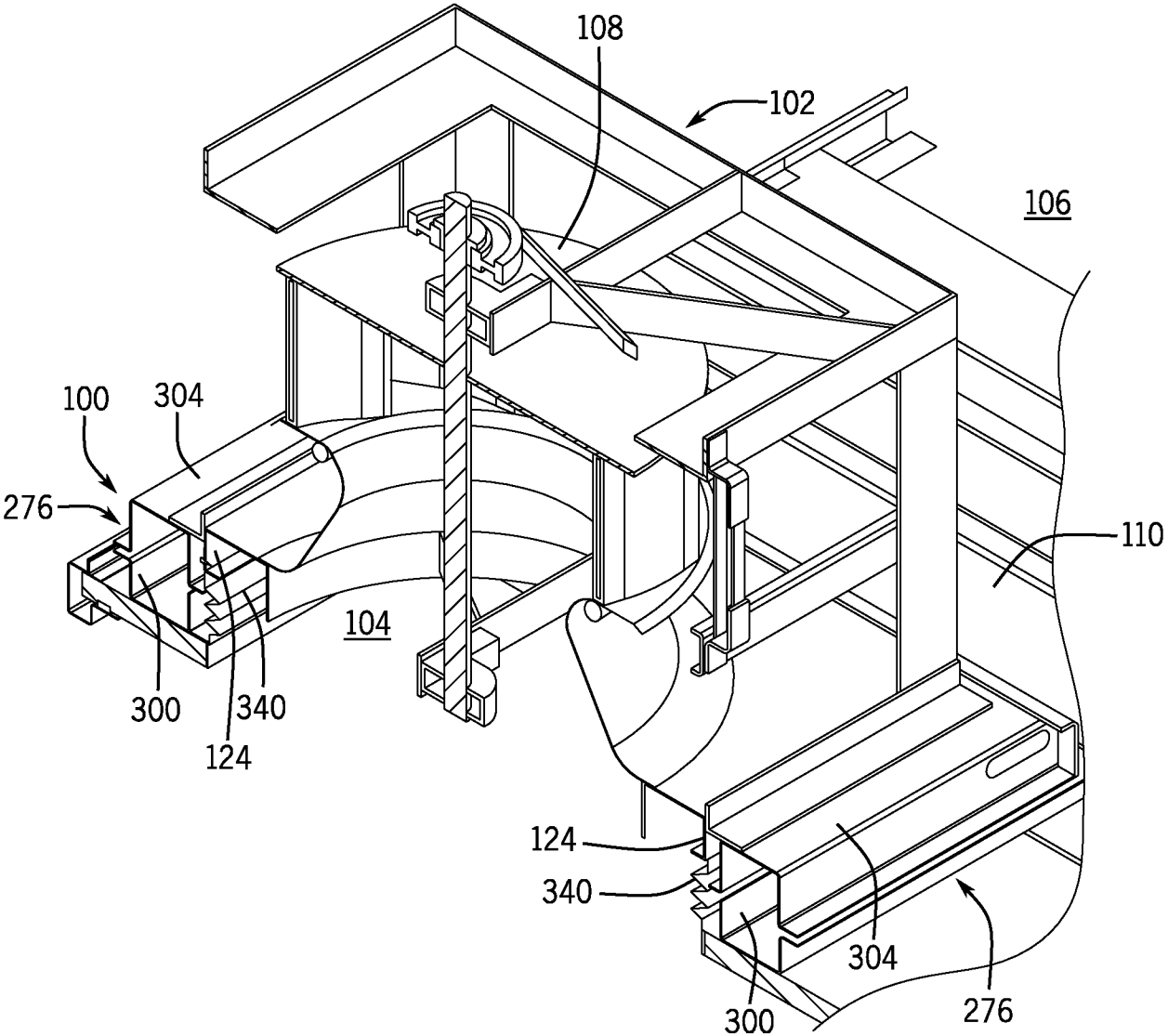
FIG. 19 is a cross-sectional perspective view of an embodiment of the interface for the fan assembly having a bellow, in accordance with an aspect of the present disclosure.

In still further embodiments, a seal between the frame 110 and the fan assembly 102 may be formed via a bellow 340. For example, FIG. 19 is a cross-sectional perspective view of an embodiment of the interface 100 that includes the bellow 340. For example, the bellow 340 may be coupled to the frame 110, the first portion 300 of the support structure 276, and/or the flange 124 of the fan assembly 102. As such, the bellow 340 may form a seal between the opening 104 and the fan assembly 102 to block air from flowing out of the opening 104 through a gap formed between the frame 110 and the fan assembly 102.

Figure 20:
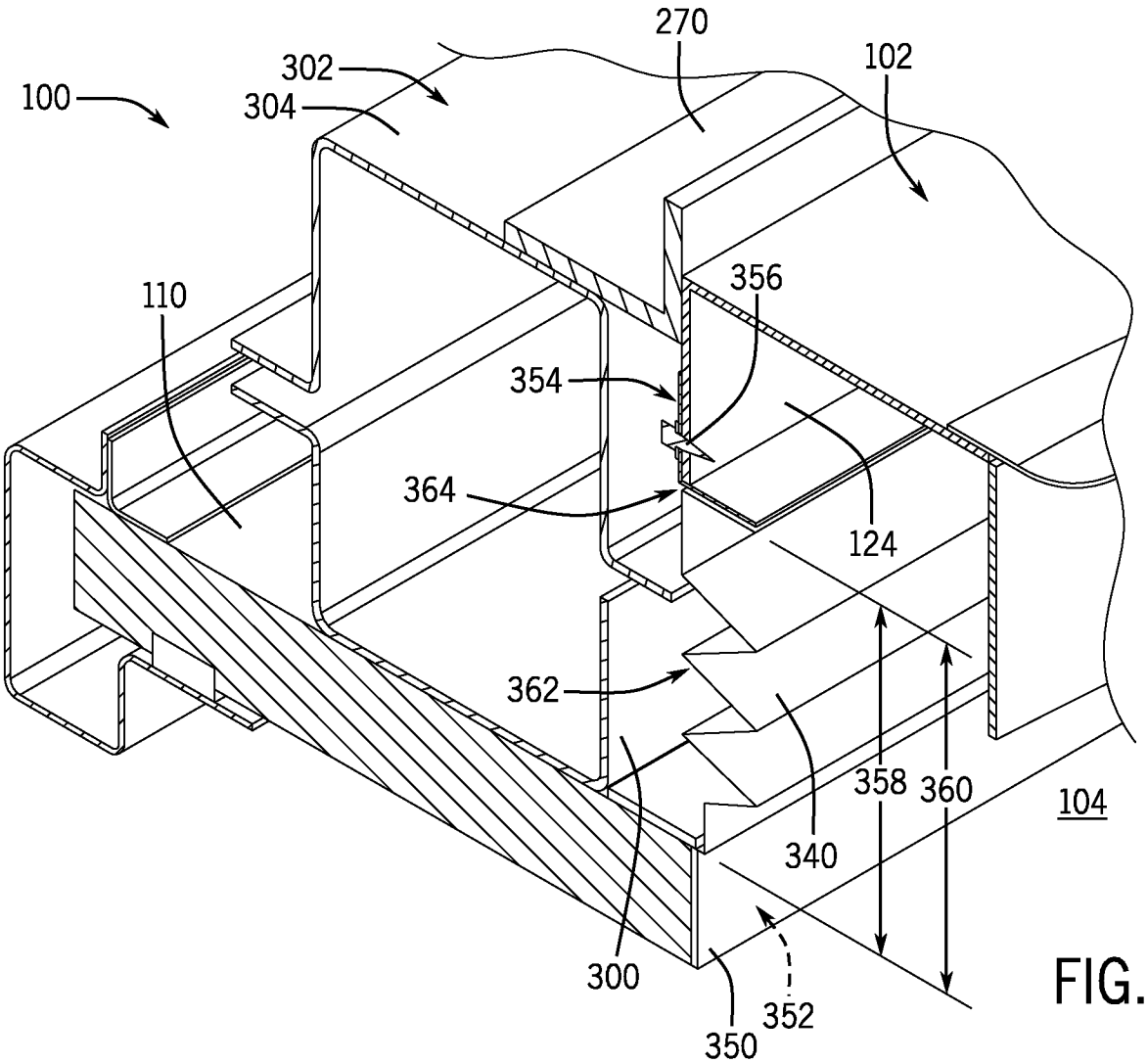
FIG. 20 is a partial cross-sectional perspective view of an embodiment of the interface having the bellow, in accordance with an aspect of the present disclosure.

FIG. 20 is a partial cross-sectional perspective view of an embodiment of the interface 100 having the bellow 340. As shown in the illustrated embodiment of FIG. 20, a first portion 350 the bellow 340 is coupled to an inner surface 352 of the frame 110 that defines the opening 104. In some embodiments, the first portion 350 of the bellow 340 may be coupled to the inner surface 352 via an adhesive, fasteners, brackets, welding, or another suitable securement technique. The bellow 340 extends from the inner surface 352 toward the flange 124 of the fan assembly 102. In some embodiments, a second portion 354 of the bellow 340 is coupled to the flange 124 via a fastener 356, such as a rivet. In other embodiments, the second portion 354 of the bellow 340 may be coupled to the flange 124 via an adhesive, another fastener, welding, or another suitable securement technique. Further, the bracket 270 is coupled to the flange 124 of the fan assembly 102. As shown in the illustrated embodiment of FIG. 20, the bracket 270 is disposed onto the surface 302 of the second portion 304 of the support structure 276. When the bracket 270 is disposed onto the surface 302, the bellow 340 may include a length or height 358 that is substantially equal to a length or height 360 of a space 362 between the frame 110 and an edge 364 of the flange 124. In other words, the bellow 340 fills a gap between the frame 110 and the fan assembly 102 to substantially seal the interface 100.

Figure 21:
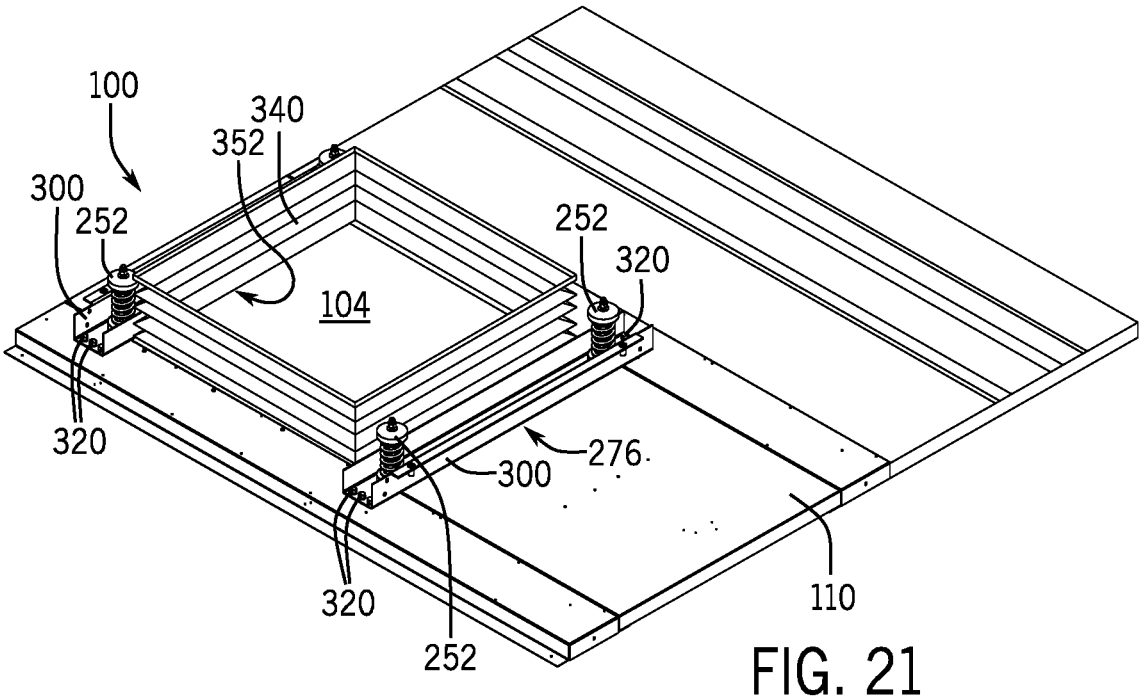
FIG. 21 is a perspective view of an embodiment of the interface having the bellow during assembly, in accordance with an aspect of the present disclosure.
Figure 22:
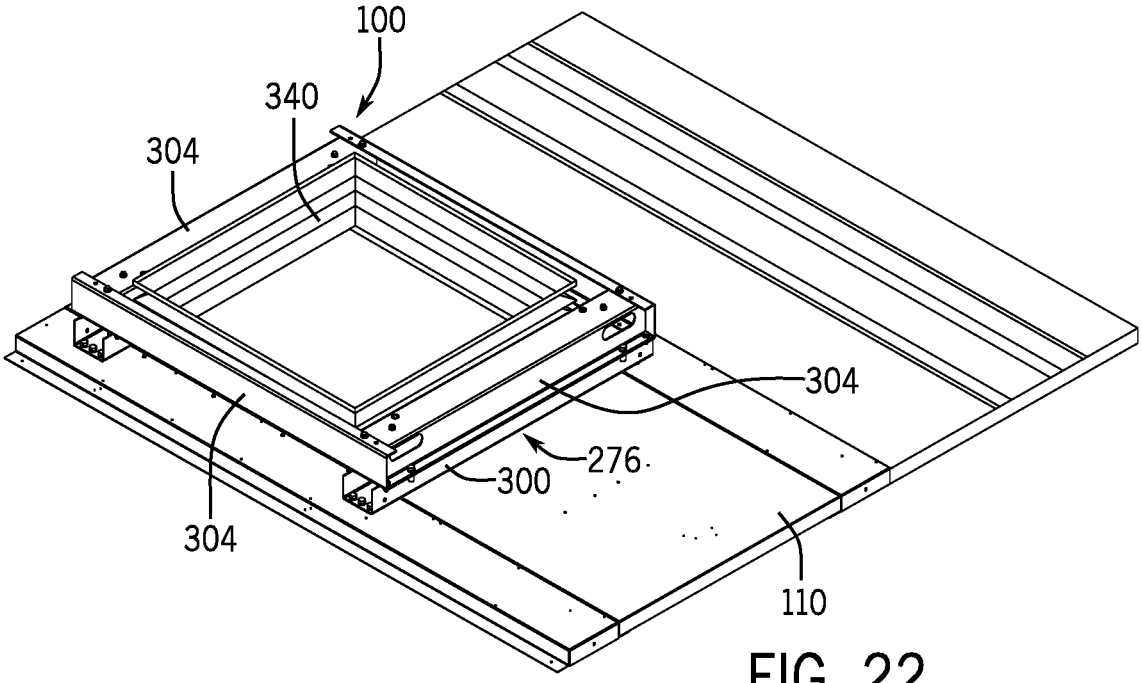
FIG. 22 is a perspective view of an embodiment of the interface having the bellow during assembly, in accordance with an aspect of the present disclosure.
Figure 23:
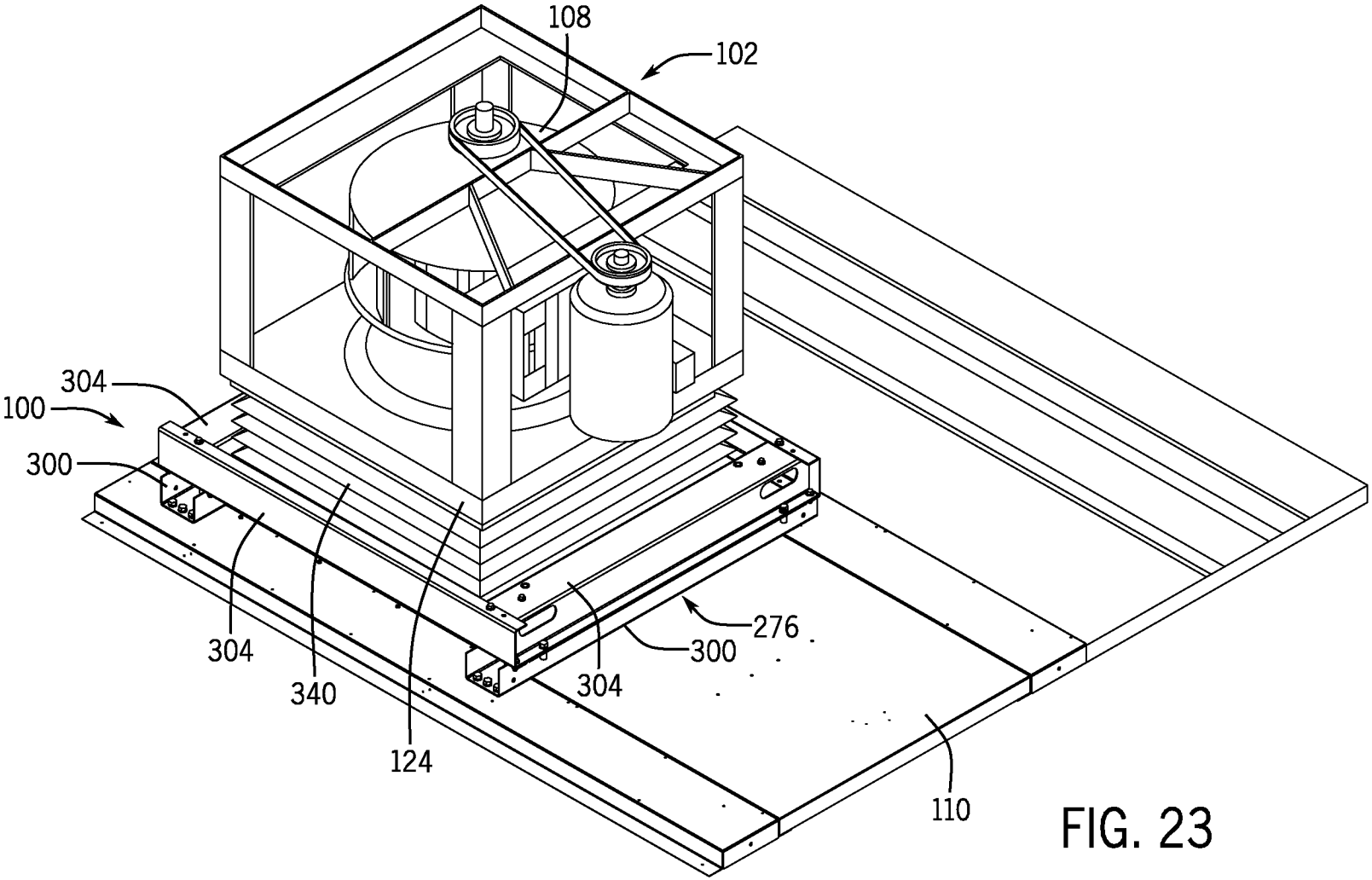
FIG. 23 is a perspective view of an embodiment of the assembled interface having the bellow, in accordance with an aspect of the present disclosure.

FIGS. 21-23 illustrate an assembly process for forming the interface 100 having the bellow 340. For example, as shown in the illustrated embodiment of FIG. 21, the bellow 340 may be disposed onto the inner surface 352 of the frame 110 defining the opening 104. In some embodiments, the bellow 340 is secured to the inner surface 352 of the frame 110 via an adhesive, fasteners, or another suitable coupling technique. Once the bellow 340 is secured to the frame 110, the first portion 300 of the support structure 276 may be disposed onto and coupled to the frame 110 via the fasteners 320. In some embodiments, the damping devices 252 are disposed between the first portion 300 and the second portion 304 of the support structure 276.

As shown in the illustrated embodiment of FIG. 22, the second portion 304 of the support structure 276 is coupled to the first portion 300 of the support structure 276. The bellow 340 may extend from the frame 110 and above the second portion 304 of the support structure 276. Accordingly, the bellow 340 may be coupled to the flange 124 of the fan assembly 108 to seal the interface 100 and block air from flowing between the frame 110 and the fan assembly 102. For example, FIG. 23 is a perspective view of the bellow 340 coupled to the flange 124 of the fan assembly 102. In some embodiments, the bellow 340 is secured to the flange 124 of the fan assembly 102 via an adhesive, fasteners, or another suitable coupling device. In any case, the bellow 340 forms a seal between the frame 110 and the fan assembly 102 to block a flow of air from exiting the opening 104 via a gap between the frame 110 and the fan assembly 102.

As set forth above, embodiments of the present disclosure may provide one or more technical effects useful in facilitating assembly of a climate management system. For example, embodiments of the present disclosure are directed to an improved interface between ductwork of a structure and a fan assembly. The improved interface may include a first bracket coupled to the fan assembly and configured to be supported by a second bracket coupled to a frame at an opening of the ductwork. Additionally, a sealing member, such as a bulb gasket, may be disposed between the first bracket and the second bracket to form a seal. In other embodiments, the interface may include a fabric disposed between a support structure of the frame at the opening of the ductwork and a bracket coupled to the fan assembly. In still further embodiments, the interface may include a bellow that is coupled to an inner surface of the frame at the opening of the ductwork and to a flange, or other suitable portion, of the fan assembly. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A fan interface, comprising:

a fan disposed within an enclosure;

a first bracket coupled to the fan, wherein the fan is configured to direct a flow of air through an opening of a duct, and the opening comprises a central axis extending therethrough;

a second bracket coupled to a frame of a base panel of the enclosure that directly surrounds the opening of the duct, wherein the first bracket and the second bracket are configured to surround the opening of the duct in an installed configuration, the first bracket comprises a first horizontally-extending flange configured to be supported by a second horizontally-extending flange of the second bracket in the installed configuration, and the first bracket is partially radially within the second bracket relative to the central axis of the opening in the installed configuration; and a gasket disposed between the first horizontally-extending flange and the second horizontally-extending flange, wherein the first bracket, the second bracket, and the gasket are configured to sealingly engage with one another without mechanical securement.

2. The fan interface of claim 1, wherein the first bracket comprises a lip extending from the first horizontally-extending flange and adjacent to at least a portion of the gasket along the central axis of the opening, such that the lip is configured to block movement of the gasket with respect to the first bracket and the second bracket.

3. The fan interface of claim 1, wherein the fan comprises a plenum fan.

4. The fan interface of claim 1, wherein the gasket is a bulb gasket.

5. The fan interface of claim 1, wherein the first bracket is coupled to a securement flange of the fan via a fastener.

6. The fan interface of claim 1, wherein the gasket is configured to compress and form a seal between the first bracket and the second bracket via a force applied from the first bracket and the fan.

7. The fan interface of claim 1, wherein the gasket comprises a semi-circular cross section having a longitudinal opening extending along a length of the gasket.

8. The fan interface of claim 7, wherein the gasket comprises a square or rectangular geometry configured to surround the opening of the duct.

9. The fan interface of claim 1, wherein the first bracket, the second bracket, or both, comprises a square or rectangular geometry configured to surround the opening of the duct.

10. The fan interface of claim 1, wherein the first bracket, the second bracket, or both, is formed from a plurality of segments, wherein each segment of the plurality of segments comprises a coupling tab at a first end of each of the segments and a coupling opening configured to receive a fastener extending through the coupling tab at a second end.

11. The fan interface of claim 1, comprising dampers disposed between the fan and the frame, wherein the dampers are configured to dampen vibrational energy generated by the fan.

12. The fan interface of claim 1, wherein the second bracket is configured to mechanically couple to the frame, and wherein the frame is positioned on a building comprising the duct.

13. The fan interface of claim 1, wherein the gasket is configured to block a flow of air from passing through a gap between the first horizontally-extending flange of the first bracket and the second horizontally-extending flange of the second bracket.

14. The fan interface of claim 1, wherein the gasket comprises a height between ½ inch and 1 inch.

15. A climate management system, comprising:

an enclosure comprising a base panel and a support frame of the base panel;

ductwork configured to direct air through a building configured to be conditioned by the climate management system, wherein the ductwork comprises an opening fluidly coupling the ductwork to an ambient environment within the enclosure, the opening of the ductwork comprises a central axis extending therethrough, and the support frame directly surrounds the opening of the ductwork;

a plenum fan disposed within the enclosure and configured to motivate a flow of the air through the ductwork; and an interface between the ductwork and the plenum fan, comprising:

a first bracket coupled to the plenum fan and configured to extend about the opening of the ductwork, wherein the first bracket comprises a first horizontally-extending flange; and a seal disposed radially inward from an outer perimeter of the first bracket relative to the central axis of the opening and between the first bracket and a second bracket of the support frame, wherein the seal is configured to block the flow of the air from passing through a gap between the first horizontally-extending flange of the first bracket and a second horizontally-extending flange of the second bracket, and the first bracket and the second bracket are configured to sealingly engage with one another via the seal without mechanical securement.

16. The system of claim 15, wherein the seal comprises a bulb gasket.

17. A climate management system, comprising:

an enclosure comprising a base panel and a frame of the base panel;

ductwork configured to direct air through a building configured to be conditioned by the climate management system, wherein the ductwork comprises an opening configured to fluidly couple the ductwork to an ambient environment within the enclosure, and the frame directly surrounds the opening of the ductwork;

a plenum fan configured to motivate a flow of the air through the ductwork; and an interface between the ductwork and the plenum fan, comprising:

a first bracket coupled to the plenum fan and a second bracket coupled to the frame of the enclosure, wherein the first bracket and the second bracket surround the opening of the ductwork, and the first bracket comprises a first horizontally-extending flange configured to be supported by a second horizontally-extending flange of the second bracket; and a seal disposed vertically between a perimeter surrounding the opening of the ductwork and the plenum fan, wherein the seal is configured to form a sealing interface between the opening and the plenum fan, and the seal comprises a bulb gasket, a fabric, a bellows, or any combination thereof.

18. The climate management system of claim 17, wherein the interface comprises dampers configured to dampen vibrational energy generated by the plenum fan.

19. The climate management system of claim 17, wherein the seal comprises the bulb gasket, and wherein the bulb gasket is disposed between the first bracket and the second bracket.

20. The climate management system of claim 17, wherein the first bracket, the second bracket, and the seal are configured to form the sealing interface without mechanical securement.

* * * * *